US005647780A

United States Patent [19]

Hosoi

[11] Patent Number: 5,647,780

[45] Date of Patent: Jul. 15, 1997

[54] VERTICALLY ADJUSTABLE STERN DRIVE FOR WATERCRAFT

[75] Inventor: Yukiharu Hosoi, Cypress, Calif.

[73] Assignee: Yamaha Hatsudoki Kabushiki Kaisha, Shizuoka, Japan

[21] Appl. No.: 486,527

[22] Filed: Jun. 7, 1995

[51] Int. Cl.[6] ..... B63H 5/125; B63H 20/00

[52] U.S. Cl. ..... 440/53; 440/61; 440/57

[58] Field of Search ..... 440/57, 58, 59, 440/61, 62, 63, 75, 83, 53

[56] References Cited

U.S. PATENT DOCUMENTS

| | | | |
|---|---|---|---|
| Re. 18,602 | 9/1932 | Svendsen et al. . | |
| 1,735,660 | 11/1929 | Svendsen et al. . | |
| 2,782,744 | 2/1957 | Staley . | |
| 3,589,326 | 6/1971 | Celli | 440/57 |
| 3,954,083 | 5/1976 | Frostrom . | |
| 3,990,660 | 11/1976 | Pipoz . | |
| 4,318,699 | 3/1982 | Wenstadt et al. . | |
| 4,449,945 | 5/1984 | Ferguson . | |
| 4,600,395 | 7/1986 | Pichl . | |
| 4,673,358 | 6/1987 | Iwai et al. . | |
| 4,682,961 | 7/1987 | Nakahama . | |
| 4,757,971 | 7/1988 | Mapes . | |
| 4,781,631 | 11/1988 | Uchida et al. . | |
| 4,842,559 | 6/1989 | Litjens et al. | 440/61 |
| 4,861,292 | 8/1989 | Griffiths et al. | 440/61 |
| 4,872,857 | 10/1989 | Newman et al. . | |
| 4,890,811 | 1/1990 | Ehni | 440/61 |
| 4,931,027 | 6/1990 | Nakahama et al. . | |
| 5,088,945 | 2/1992 | Onoue . | |
| 5,088,946 | 2/1992 | Nakayama . | |
| 5,352,137 | 10/1994 | Iwai et al. . | |
| 5,382,183 | 1/1995 | Rompre | 440/61 |

*Primary Examiner*—Stephen Avila

*Attorney, Agent, or Firm*—Knobbe, Martens, Olson & Bear, LLP

[57] ABSTRACT

A marine stern drive includes a tilt/trim and lift adjustment mechanism which raises and lowers the drive while maintaining an established trim angle. The adjustment mechanism includes a parallelogram linkage system. An upper lever of the linkage system is defined in part by a pair of tilt and trim actuators which vary the length of the upper linkage to adjust the trim position of the stern drive and for tilt up. A lower lever of the linkage system is defined between two flexible couplings of a propulsion drive train. One of the flexible couplings is coupled to a lower drive unit of the stern drive which permits the lower lever to rotate without changing the trim angle of the lower drive unit.

39 Claims, 9 Drawing Sheets

VERTICAL
LONGITUDINAL
LATERAL 12
80
82
84
14
96
84
92
90
78
22
94
98
80
48
10
36
50
114
114
30
28
24
18
20

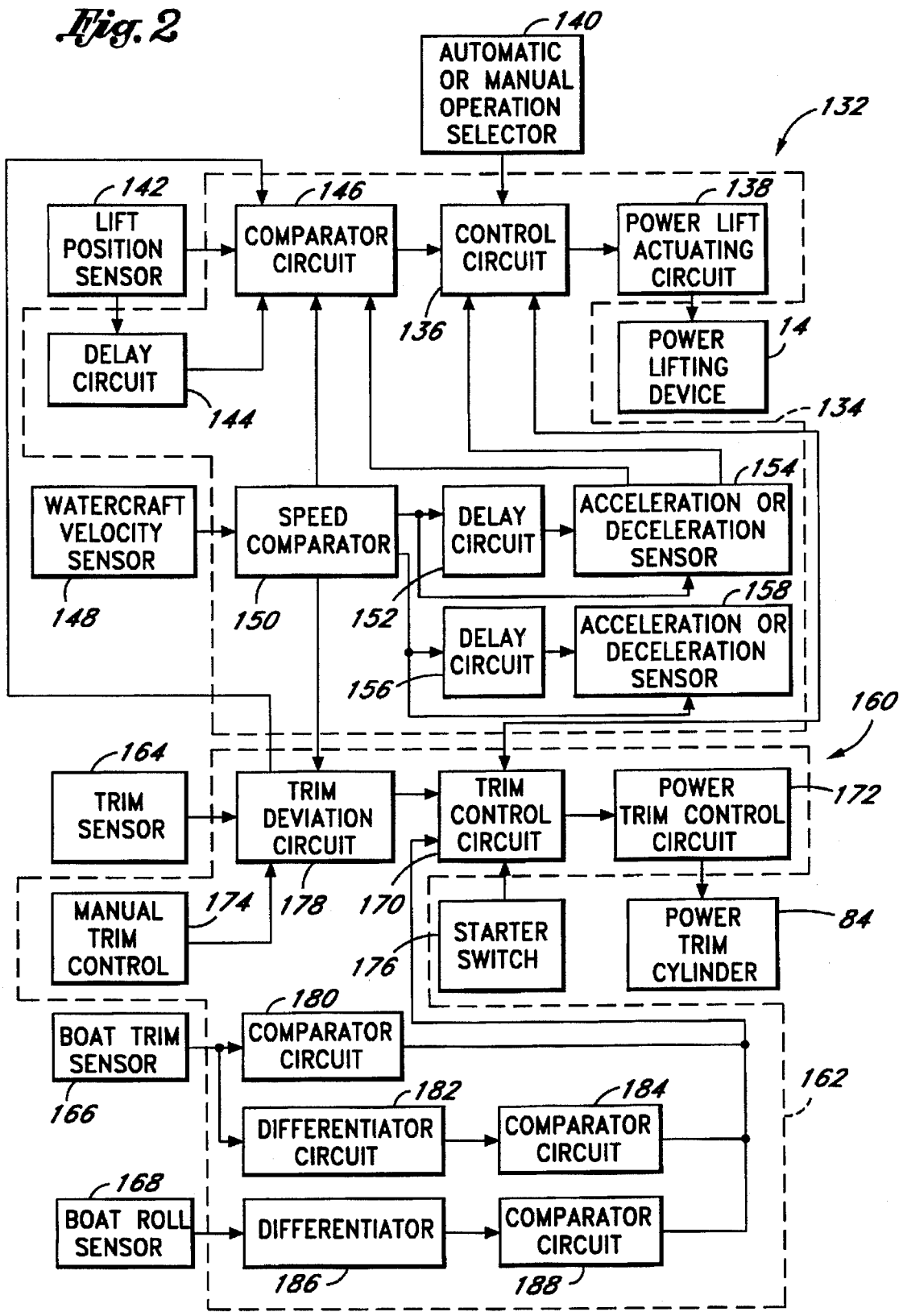
Fig. 2
140
AUTOMATIC OR MANUAL OPERATION SELECTOR
132
142
LIFT POSITION SENSOR
146
COMPARATOR CIRCUIT
CONTROL CIRCUIT
138
POWER LIFT ACTUATING CIRCUIT
136
DELAY CIRCUIT
144
POWER LIFTING DEVICE
14
134
154
WATERCRAFT VELOCITY SENSOR
SPEED COMPARATOR
DELAY CIRCUIT
ACCELERATION OR DECELERATION SENSOR
148
150
152
158
DELAY CIRCUIT
ACCELERATION OR DECELERATION SENSOR
156
160
164
TRIM SENSOR
TRIM DEVIATION CIRCUIT
TRIM CONTROL CIRCUIT
POWER TRIM CONTROL CIRCUIT
172
MANUAL TRIM CONTROL
174
178
170
STARTER SWITCH
POWER TRIM CYLINDER
84
176
180
BOAT TRIM SENSOR
COMPARATOR CIRCUIT
162
166
182
184
DIFFERENTIATOR CIRCUIT
COMPARATOR CIRCUIT
168
BOAT ROLL SENSOR
DIFFERENTIATOR
COMPARATOR CIRCUIT
186
188

VERTICALLY ADJUSTABLE STERN DRIVE FOR WATERCRAFT

BACKGROUND OF THE INVENTION

1. Field of the Invention

The present invention relates in general to a watercraft, and more specifically to a vertically adjustable outboard drive of a watercraft.

2. Description of Related Art

The desirable trim angle of an outboard drive varies with watercraft running condition. For instance, the bow of the watercraft should press against the water when accelerating from rest or from a slow speed. To achieve this condition, the angle of the propeller shaft is disposed at a negative angle relative to the horizontal (i.e., at a negative trim angle). That is, a thrust vector produced by the propeller is out of the water. When running at high speed, the propeller is raised or trimmed to position the propeller shaft at a positive trim angle relative to the horizontal within the range of about 0° to 15°.

The desirable height or vertical location of the propeller of the outboard drive in the water in which the watercraft is operated also varies depending upon the running condition of the watercraft. When accelerating from low speeds, the vertical position of the outboard drive should remain relatively low in the water until the watercraft reaches a planing condition. Up until that time, the vertical position should not change, but trim condition is adjusted to obtain optimum acceleration and subsequently to maintain cruising speed once on plane. The propeller of the outboard drive is raised once the watercraft is on plane so as to minimize water resistance of the lower unit (i.e., reduce drag on the lower unit) and to improve stability.

Various linkage and suspension systems have been proposed in connection with outboard motors to allow for adjustment of the tilt and lift positions of the outboard motor to gain the advantages of the above principles. Prior stern drives, however, have not provided for both tilt and lift adjustment of the drive.

SUMMARY OF THE INVENTION

A need therefore exists for an adjustable stern drive in which the trim position and the lift position of the drive relative to the horizontal can be varied depending upon the running condition of the watercraft.

In accordance with one aspect of the present invention, an adjustable stern drive for a watercraft comprises a propulsion device. The propulsion device is arranged to lie at least partially below a surface of a body of water in which the watercraft is operated. The propulsion device is adapted to produce a thrust along a thrust vector which defines a thrust angle with the water surface. A position control mechanism is attached to the propulsion device. The position control mechanism is adapted to move the propulsion device between a first position, in which the propulsion device lies at a first distance from the water surface, to a second position, in which the propulsion device lies at a second distance from the water surface, without substantially changing the thrust angle between the thrust vector produced by the propulsion device and the water surface.

Another aspect of the present invention involves a stern drive for a watercraft. The stern drive comprises an output shaft which is adapted to be rotationally driven by a motor. A flexible coupling connects the output shaft to an input shaft of a propulsion drive train of the stern drive unit. A drive transfer mechanism connects the input shaft to an upper drive shaft of the drive train. At it lower end, a second flexible coupling connects the upper drive shaft to a lower drive shaft. The lower drive shaft in turn drives a transmission. The transmission selectively couples the lower drive shaft to at least one propulsion shaft which drives at least one propulsion device of the stern drive.

An additional aspect of the present invention involves a position control mechanism for supporting a marine outboard drive (i.e., an outboard motor, a stern drive unit or the like). The position control mechanism comprises a linkage system formed by at least first and second parallel levers. Each lever has a rear end. The rear ends of the levers define end points of a link line. The first lever is adjustable in length so as to change an angle between the link line and the second lever.

BRIEF DESCRIPTION OF THE DRAWINGS

These and other features of the invention will now be described with reference to the drawings of a preferred embodiment which is intended to illustrate and not to limit the invention, and in which:

FIG. 2 is a schematic block diagram illustrating the construction and operation of a position control system which can be used with the stern drive of FIG. 1;

DETAILED DESCRIPTION OF A PREFERRED EMBODIMENT

Figure 1:
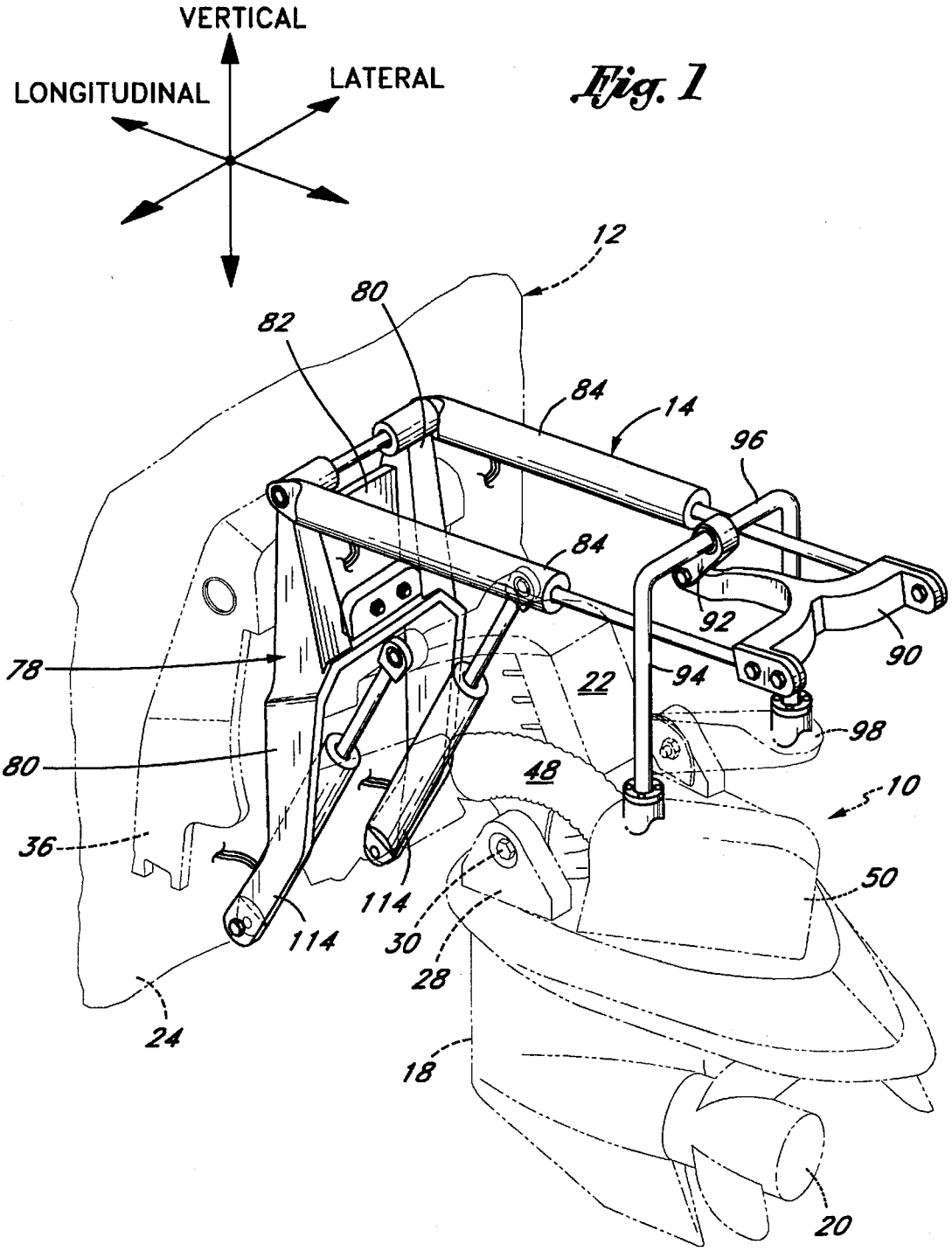
FIG. 1 is a perspective view of a marine stern drive in accordance with a preferred embodiment of the present invention.

FIG. 1 illustrates an adjustable stern drive 10 for a watercraft 12 which is configured in accordance with a preferred embodiment of the present invention. The drive 10 includes a position control mechanism, generally identified by reference numeral 14, which adjusts the lift and trim positions of the stern drive 10, as well as tilts up the stern drive 10 for storage. Although the present position control mechanism 14 is described in terms of a stern drive unit, it is understood that the certain aspects of present position control mechanism can be adapted for use with an outboard motor as well.

An automatic control system 16, schematically diagramed in FIG. 2, desirably operates the position control mechanism 14. The control system 16 automatically adjusts the lift and trim positions of the drive 10 according to the running condition of the watercraft 12, as described below.

Figure 3:
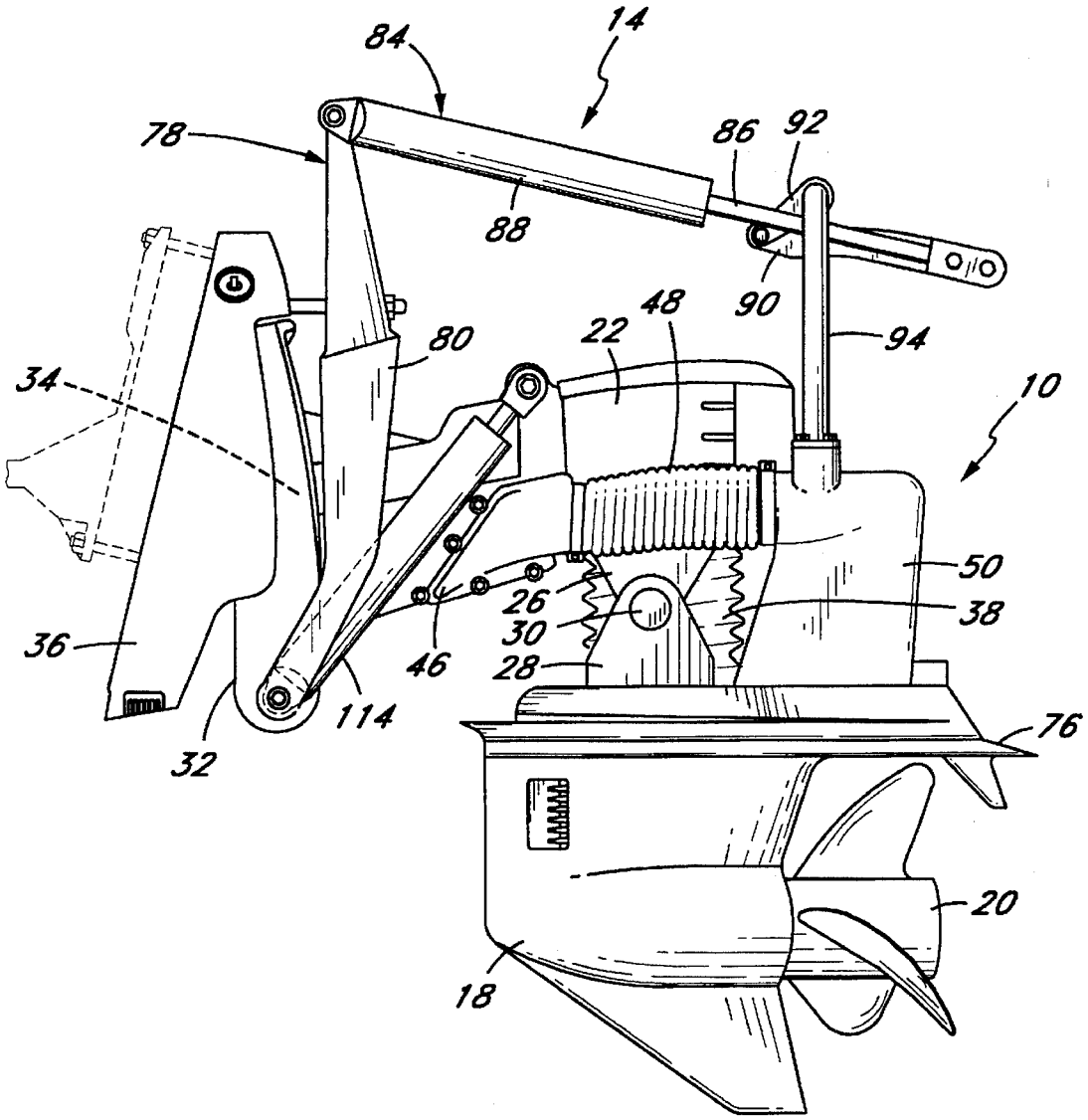
FIG. 3 is a side elevational view of the marine stern drive of FIG. 1 in a lowered position at a zero trim angle.

With reference to FIGS. 1 and 3, the present stern drive 10 desirably includes a conventional lower unit 18 with a propulsion device 20, such as, for example, a propeller. The present stern drive 10, however, can be used with other types of propulsion devices, such as, for example, counter-rotating propellers, hydrodynamic jets, or the like.

An outer housing 22 of the drive 10 supports the lower unit 18 further from a transom 24 of the watercraft 12 than conventional stern drives. This position, as discussed below, accommodates the arrangement of the present position control mechanism 14, as well as positions the propulsion device 20 in deeper water beyond a water recovery zone created directly behind the watercraft transom 24 as the watercraft moves through the water. The position control mechanism 14 supports both the lower unit 18 and the outer housing 22 off the transom 24 of the watercraft 12.

In the embodiment illustrated in FIG. 1, a hinge connection supports the lower unit 18 at a rear end of the outer housing 22. The outer housing 22 and the lower unit 18 include a pair of cooperating brackets 26, 28 which are positioned on either side of the drive 10. A pair of hinge pins 30 connect the bracket parings 26, 28 together in a manner allowing the lower unit 18 and outer housing 22 to rotate relative to each other about the common axis of the pins 30.

The outer housing 22 is connected to a gimbal housing 32, which houses a conventional gimbal ring 34. The gimbal ring 34 connects the stern drive 10 to the watercraft 12 and allows the stern drive 10 to rotate about the vertical axis, as well as to pivot about the lateral axis to lift the drive 10, as described below. The gimbal ring 34 and housing 32 are attached to a transom bracket 36, which in turn is mounted onto the transom 24 of the watercraft 12.

A steering cylinder (not shown) desirably extends between the outer housing 22 and the gimbal housing 32, and is attached in a known manner. The steering cylinder, operated and controlled by conventional mechanisms and a known hydraulic circuit, rotates the stern drive 10 about the vertical axis for steering purposes, as known in the art.

Figure 4:
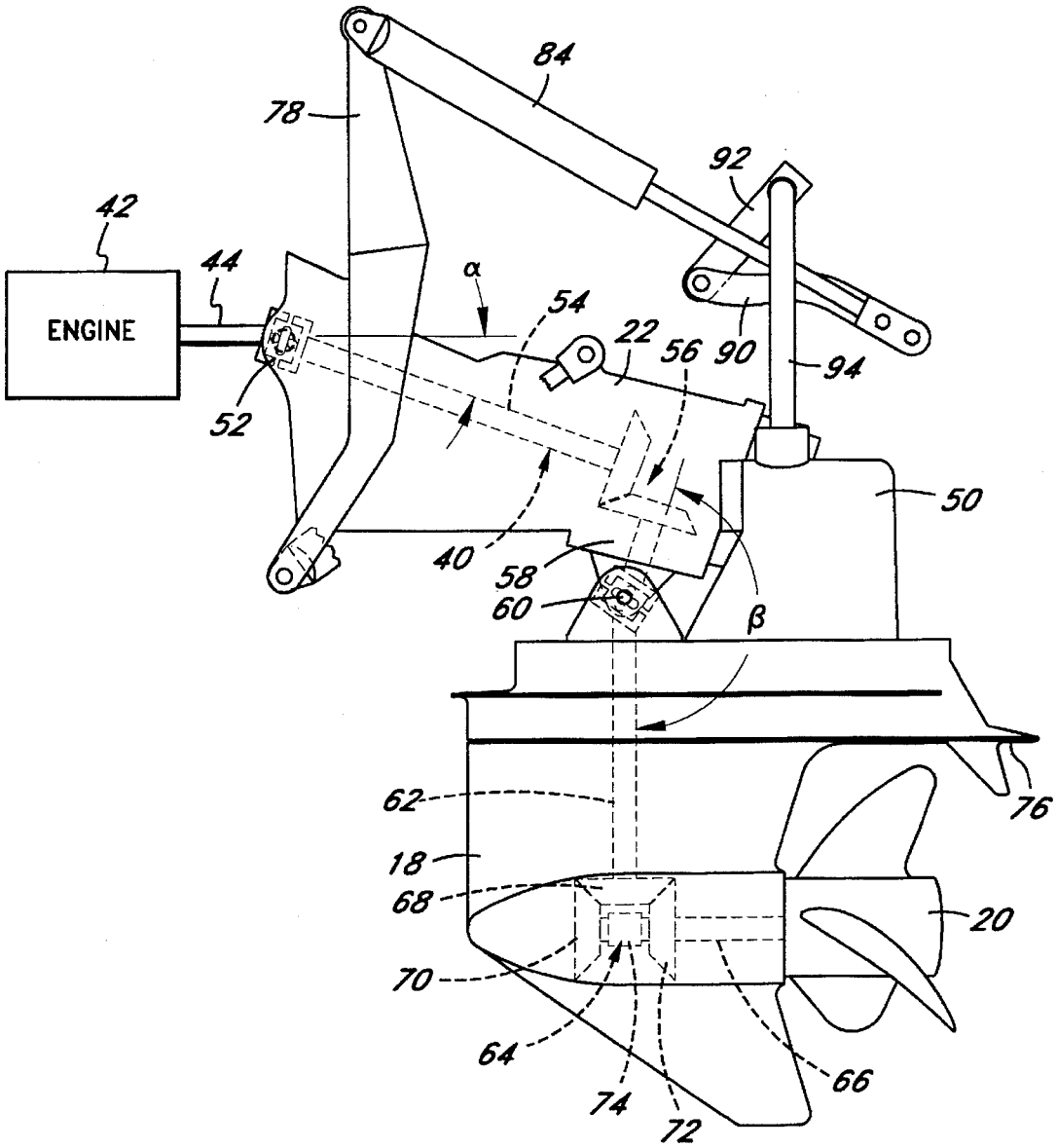
FIG. 4 is a schematic side elevational view of the marine stern drive of FIG. 3 illustrating a propulsion drive train of the stern drive in phantom line.

A flexible housing 38 interconnects the lower unit 18 and the outer housing 22. In the illustrated embodiment, the flexible housing 38 is a bellow which is positioned between the hinge bracket pairings 26, 28. As best seen in FIG. 4, the bellow 38 surrounds a portion of a propulsion drive train 40 which extends between the outer housing 22 and the lower unit 18, as described below.

An engine 42 (schematically shown in FIG. 4), such as, for example, an internal combustion engine, powers the stern drive 10. The engine 42 is connected to an output shaft 44 which extends through the transom 24 and drives the propulsion drive train 40 of the stern drive 10.

With reference back to FIG. 3, an exhaust manifold of the engine 42 desirably communicates with at least one exhaust passage 46 formed within the outer housing 22 of the stern drive 10. The exhaust 46 passage extend along at least one side of the outer housing 22. A conventional flexible exhaust hose 48 connects the outer housing exhaust passage 46 to an expansion chamber housing 50 positioned above the rear end of the lower unit 18. As understood from FIG. 1, the expansion chamber housing 50 lies to the side of the lower unit 18 so as not to interfere with the relative movement between the lower unit 18 and the outer housing 22.

An expansion chamber within the housing 50 communicates with an exhaust discharge passage (not shown) in the lower unit 18. The lower unit discharge passage leads into a discharge conduit formed within a hub of the propeller 20 so as to discharge engine exhaust to a lower pressure region in the water behind the propeller 20. Of course, the engine 42 can also or in the alternative exhaust through the watercraft transom 24, as known in the art.

The individual components of the marine stern drive 10 will now be described in detail. For the purpose of describing the individual components, a coordinate system is provided, as seen in FIG. 1, having mutually orthogonal coordinates oriented as follows: a "longitudinal" coordinate extend in the direction between the bow and the stern of the watercraft 12; a "lateral" coordinate extending in the direction between the port and starboard sides of the watercraft 12; and a vertical coordinate extending orthogonal to both the longitudinal and lateral coordinates. In addition, as used herein, "forward" and "rearward" refer to the direction toward or away from the bow, respectively, in the direction of the longitudinal coordinate.

Propulsion Drive Train

With reference to FIG. 4, the output shaft 44 extends from the engine 42 and passes through the transom 24 of the watercraft 12. A first flexible coupling 52 connects the output shaft 44 to an input shaft 54 of the propulsion drive train 40. In the illustrated embodiment, a universal joint, preferably a double Cardan joint with at least a 30° to 40° range of movement, interconnects the output shaft 44 and the input shaft 54. The relative shaft angle $\alpha$ between the input and output shafts 54, 44 thus can vary by at least ±15° to ±20°.

As understood from FIG. 4, the input shaft 54 lies at about a −15° to −20° shaft angle a relative to the output shaft 44 with the stern drive 10 positioned in a fully lowered position. The first universal joint 52 allows the input shaft 54 to pivot relative to this coupling to about a 15° to 20° shaft angle. This allows the input shaft 54 to rotate with the outer housing 22 relative to the gimbal ring 34 and first flexible coupling 52 when lifting the lower unit 18.

The input shaft 54 extends through the outer housing 22 and is suitably journaled therein. The input shaft 54 rotates with the output shaft 44 with little energy loss through the first universal joint 52.

A drive transfer mechanism 56 connects the input shaft 54 to an upper drive shaft 58. In the illustrated embodiment, the input shaft 54 is connected to a bevel gearset 56 which transmits rotation between the input shaft 54 and an intersecting upper drive shaft 58 of a propulsion drive train 40. The bevel gearset 56 desirably includes a pair of bevel gears made for a shaft angle of about 90°; however, it is contemplated that the upper drive shaft 58 and the input shaft 54 can intersect at other angles. The bevel gearset 56 desirably is located toward the rear end of the outer housing 22.

The upper drive shaft 58 depends from the bevel gearset 56 into the bellow housing 38. A second flexible coupling 60 connects the upper drive shaft 58 to a lower drive shaft 62. In the illustrated embodiment, a second universal joint 60, preferably a double Cardan joint, interconnects the output shaft 44 and the input shaft 54. The second universal joint 60 desirably has a sufficient range of movement to allow said lower drive shaft 62 to move through at least a 15° to 20° range of motion on either side of the vertical axis during running conditions and through at least ±25° relative to the vertical axis for tilt-up of the drive 10.

The second universal joint 60 desirably is positioned at the hinge point between the lower unit 18 and the outer housing 22 to allow the lower drive shaft 62 to pivot relative to this coupling 60 when the trim position of the lower unit 18 is adjusted. That is, the lateral axis about which the lower drive shaft 62 pivots is aligned with the lateral axis (defined by the hinge pins 30) about which the lower unit 18 pivots.

As understood from FIG. 4, the lower drive shaft 62 desirably lies along the vertical axis with the propeller 20 in a zero trim angle position, as described below. In this position, the lower drive shaft 62 lies at about a 160° to 165° shaft angle β relative to the upper drive shaft 58. The second universal joint 60 allows the lower drive shaft 62 to pivot through ±15° to ±20° to either side of the vertical axis to adjust the trim position of the lower unit 18.

A transmission 64 selectively couples the lower drive shaft 62 to a propulsion shaft 66. The transmission 64 advantageously is a conventional forward-neutral-reverse-type transmission. In this manner, the lower drive shaft 62 drives the propulsion shaft 66, which rotates either in a first direction or in a second counter direction depending upon the selected drive condition.

In the illustrated embodiment, the transmission 64 includes a drive pinion 68 fixed to the lower end of the lower drive shaft 62. Two vertically orientated, opposing bevel gears 70, 72 mesh with the pinion 68 which drives the gears 70, 72 in opposite directions. A spline connection (not shown) connects a clutch slider 74 to the propulsion shaft 66. The clutch 74 couples the shaft 66 to one of the driven gears 70, 72 depending upon the selected drive condition.

Although a positive-contact clutch (e.g., a dog clutch) is illustrated, the transmission 64 can include other types of clutching mechanisms, such as, for example, a hydraulic clutch or a cone clutch. It also should be understood that the positions of the gearset 56 and the transmission 64 can be reversed such that a gearset interconnects the lower drive shaft 62 and the propulsion shaft 66 and a forward-neutral-reverse type transmission interconnects the input shaft 54 and the upper drive shaft 58.

A conventional shifting mechanism (not shown) controls the transmission 64. The shifting mechanism desirably includes a gear shifter coupled to a shift linkage via a bowden wire cable. The gear shifter is mounted conventionally, proximate to the steering controls (not shown) of the watercraft 12 and includes a shift lever. The bowden wire cable desirably extends from the gear shifter to a conventional actuator mechanism which operates the clutch 74 in response to movement of the shift lever, as known in the art.

The propulsion shaft 66 carries the propeller 20 which is suitably fixed to the end of the propulsion shaft 66. The propeller 66 lies below a cavitation plate 76 of the lower unit 18. The blades of the propeller 20 desirably have an adequate pitch angle to produce a driving thrust when rotated. Surface piercing propeller blades also can be used with the present adjustable stern drive 10.

Position Control Mechanism

The position control mechanism 14 includes a linkage system similar to a parallelogram linkage system. At least one link of the linkage is adjustable in length to move the lower unit 18 relative to the watercraft transom 24 for tilt and trim operation.

Figure 5:
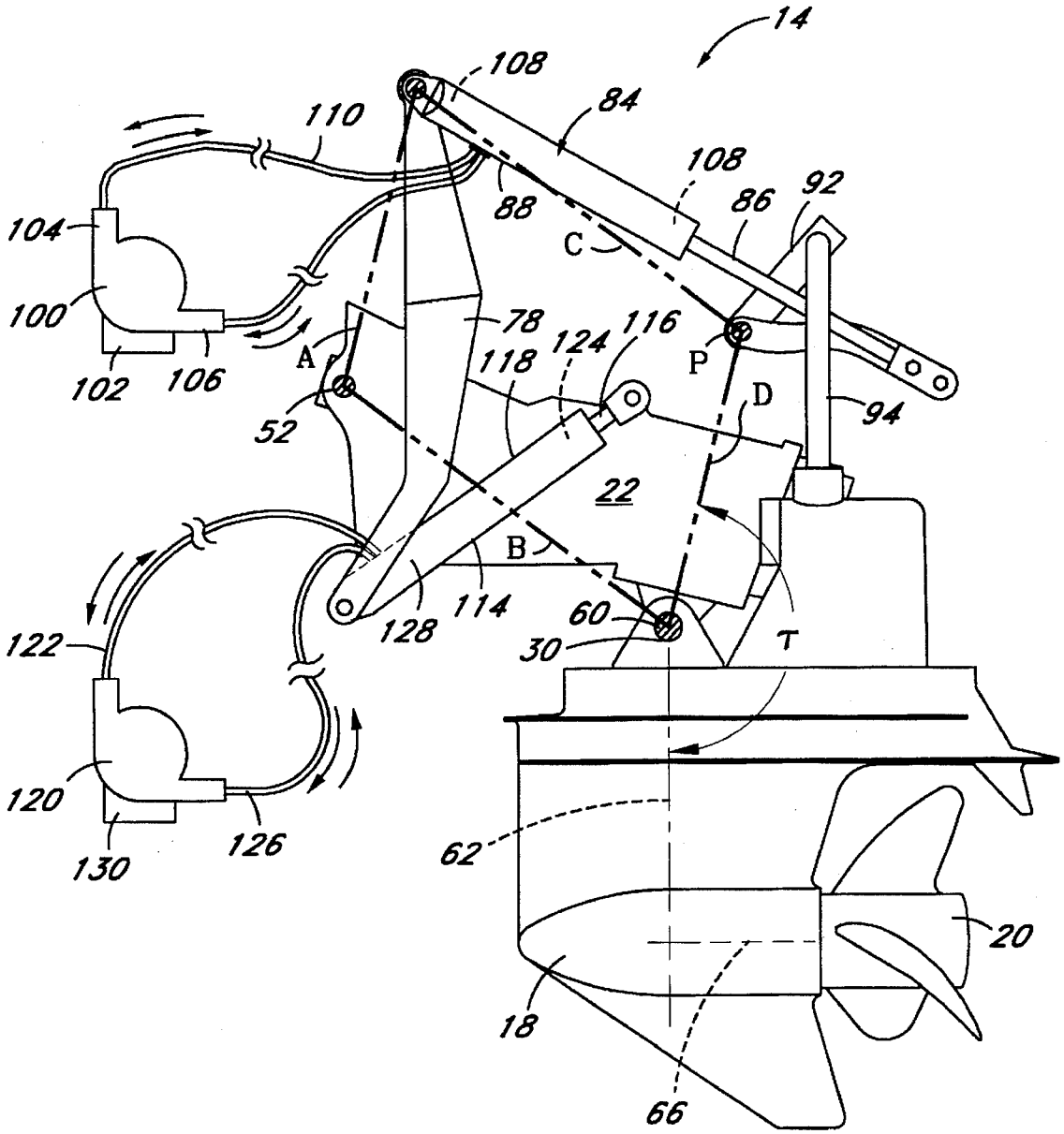
FIG. 5 is a schematic side elevational view of the marine stern drive of FIG. 3 illustrating a linkage system of the position control mechanism of the stern drive.

FIG. 5 best illustrates the links of the present linkage system in phantom lines. A fixed link A is defined between the first universal joint 52 and an upper end of a support yoke 78.

As best seen in FIG. 1, the legs 80 of the support yoke 78 are attached on either side of the gimbal ring housing 32 and extend upward in the vertical direction. The lower end of each leg 80 angles toward the transom 24 of the watercraft 12 in order to clear the lower end of the transom bracket 36. In the illustrated embodiment, the lower end of each leg 80 lies substantially below the first universal joint 52 in the longitudinal direction. The upper end of each yoke leg 80 lies slightly rearward of the first universal joint 52, as seen in FIG. 5.

With reference back to FIG. 1, a crossbar 82 interconnects the generally parallel legs 80 of the yoke 78 toward the upper end of the legs 80. The crossbar 82 is positioned so as not to interfere with the rotational movement of the outer housing 22 about the lateral pivot axis defined by the gimbal ring 34 and the first universal joint 52.

As seen in FIG. 5, a lower lever B of the linkage system is defined between the first and second universal joints 52, 60. Because of the bevel gearset 56 rigidly connects together the input shaft 54 and the upper drive shaft 58, the shaft angle between these shafts 54, 58 remains unchanged during the trim and/or lift adjustment operations. The distance between the universal joints 52, 60 therefore remains unchanged during these operations.

In the illustrated embodiment, an upper lever C of the linkage system is defined in part by a pair of parallel tilt and trim actuators 84. Each actuator 84 includes an extendable arm 86 which increases and decreases the length of the upper lever C. An end of an actuator cylinder body 88 is rotatably connected to the upper end of one of the yoke legs 80, and an outer end of the actuator arm 86 is fixed to a swing arm 90. The orientation of the actuators 84, however, can be reversed. The present linkage also can have only a single, centrally orientated actuator, rather than the pair of actuators illustrated in the present embodiment.

The swing arm 90 supports the ends of the actuator arms 86. In the illustrated embodiment, the swing arm 90 generally has a Y-shape with the outer ends of the actuator arms 86 rigidly fixed to the outer ends of the swing arm 90. A central leg of the swing arm 90 is pivotably connected to an end of a support arm 92 so as to rotate relative to the support arm 92 when the lengths of the actuators 84 change. The pivot connection between swing arm 90 and the support arm thus forms a flexible coupling between the end of the swing arm 90 (i.e., the end of the upper lever C) and a bracket 94, which in part interconnects the upper and lower levers B and C. Other types of flexible couplings, of course, can also be used.

A support bracket 94 supports an upper end of the of support arm 92. The upper end of the support arm 92 is fixed on a crossbar 96 of the bracket 94.

In the illustrated embodiment, the support bracket 94 generally has an inverted "U" shape. The lower ends of the bracket are attached to the lower unit 18. As seen in FIG. 1, one side of the bracket 94 is bolted on top of the exhaust expansion chamber housing 50 and the other side is bolted to an extension 98 of the hinge bracket 28 connected to the lower unit 18. In this manner, the bracket 94, lower unit 18 and hinge brackets 28 interconnect the rear ends of the upper lever C (defined by the actuators 84 and the swing arm 90) and the lower lever B (defined by the input shaft 54 and upper drive shaft 58 contained within the outer housing 22). This linkage between the rear ends of the upper and lower levers B and C causes the one lever to follow the rotational movement of the other.

As understood from FIG. 5, the distance between the actuator arm ends and the connection point P (i.e., the joint) between the swing arm 90 and the support arm 92 remains constant during the trim and lift operations of the stern drive 10. The upper lever C of the linkage system is thus defined between the upper end of the yoke leg 80 and the joint P between the swing arm 90 and support arm 92 along the parallel axes of the actuators 84. Actuating the actuators 84 changes the length of this lever C, as described below.

As seen in FIG. 5, a connecting link line D is defined between the rear ends of the upper and lower levers B and C of the linkage system. That is, the link line D extends between the second universal joint 60 and the joint P between the swing and support arms 90, 92. The length of this link line D remains unchanged during the lift operation of the stern drive 10, but increases and decreases during trim up and trim down operations, respectively. The length of the link line D changes with rotation of the support arm 92 about the pivot point P.

Figure 6:
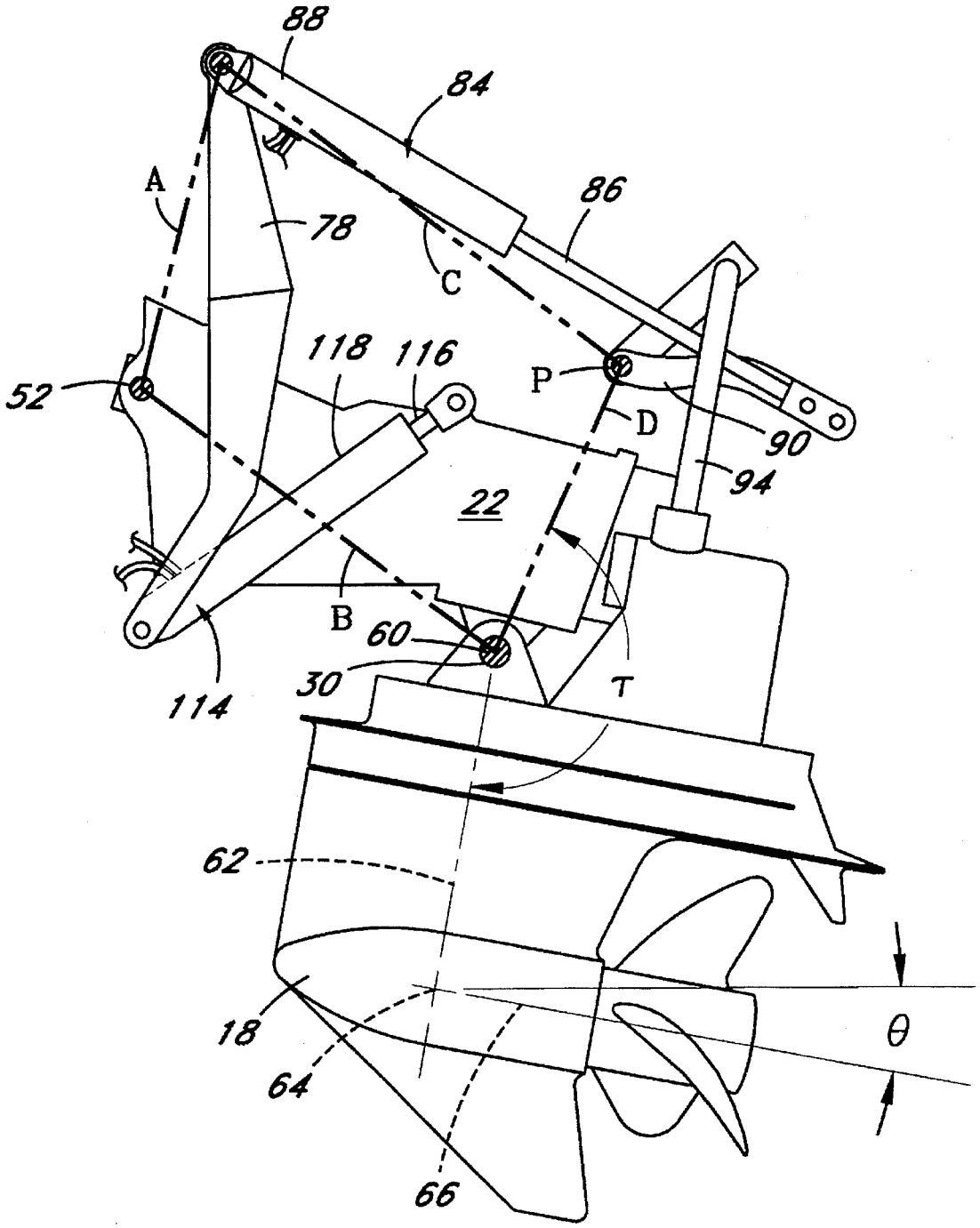
FIG. 6 is a schematic side elevational view of the position control mechanism of FIG. 5 with the marine stern drive 5 in a lowered, trimmed-down position.
Figure 7:
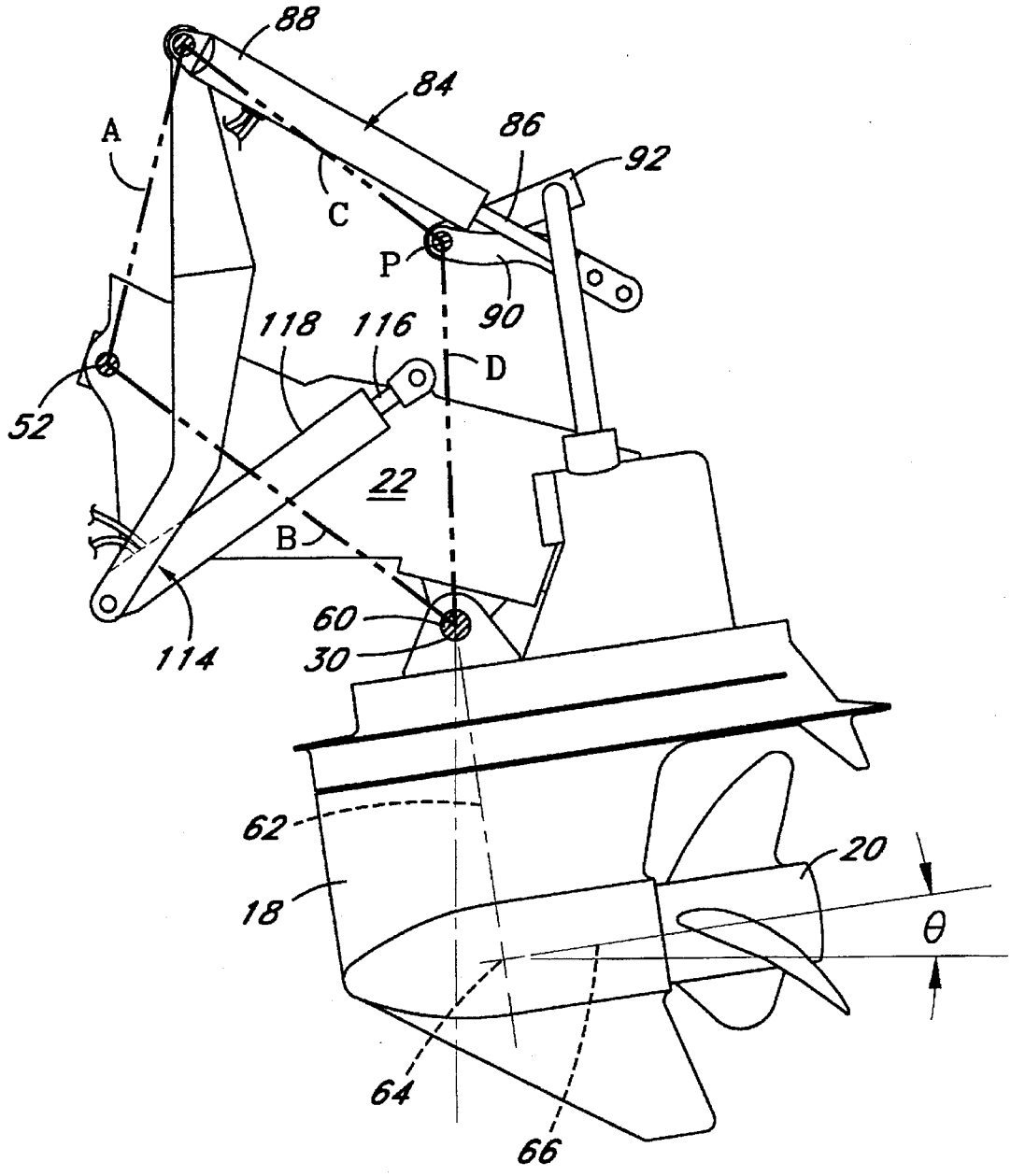
FIG. 7 is a schematic side elevational view of the position control mechanism of FIG. 5 with the marine stern drive in a lowered, trimmed-up position.

With reference to FIGS. 5 and 6, the actuators 84 control the trim position of the propeller 20 and propulsion shaft 66. In the illustrated embodiment, as seen in FIG. 6, the actuators arms 86 extend to a point approximately at the end of the arm's travel, but not fully extended, with the lower unit 18 in a full trim down position. In this position, the propulsion shaft 66 lies at a 31 15° to −20° trim angle θ. As used herein, trim angle θ refers to an angle formed between the propulsion shaft 66 and the horizontal (i.e., the surface plane of the body of water in which the watercraft 12 is operated). In a trim up position, as seen in FIG. 7, the actuator arms 86 retract to lessen the length of the actuators 84 which causes the propulsion shaft 66 to lie at a positive trim angle θ with the propeller 20 located above the transmission 64.

The tilt and trim movement of the stern drive 10 desirably is achieved using hydraulic actuators; however, it is understood that pneumatic or electric actuators can alternatively be used, but are not preferred. A conventional hydraulic circuit powers the actuators 84.

With reference to FIG. 5, the hydraulic circuit includes a reversible positive displacement fluid pump 100 that is selectively driven in opposite directions by an electric motor 102. The pump 100 has a pair of ports 104, 106 either of which can function as a pressure port with the other functioning as the suction port, depending upon the direction of rotation of the motor 102 and the pump 100. Conventional makeup lines (not shown) connect the pump 100 to a hydraulic fluid reservoir (not shown) to provide makeup fluid if required, as known in the art.

The reversible fluid pump 100 selectively pressurized one of two fluid motor chambers 108 within each actuator cylinder 88 to effect trim angle adjustments to the stern drive 10. A first set of fluid lines 110 connect one port 104 of the pump 100 to corresponding fluid motor chambers 108 on one side of an actuator piston within each actuator cylinders 88. A second set of fluid lines 112 connect the other pump port 104 to corresponding fluid motor chambers 108 of the other side of the actuator piston.

The hydraulic circuit can also include a manually operated valve (not shown) positioned between the fluid lines 110, 112 and connected to the hydraulic fluid reservoir. An operator can open the valve in order to manually tilt up the stern drive 10 without significant fluid resistance. Because the hydraulic circuit is believed to be conventional, further description of the hydraulic circuitry is thought unnecessary for an understanding of the present adjustable stern drive 10.

As also seen in FIG. 5, a pair of lift actuators 114 extend between the outer housing 22 and the gimbal ring housing 32, inside the legs 80 of the support yoke 78. Each actuator 114 includes an extendable arm 116 which increases and decreases the length of the actuator 114. An end of an actuator body or cylinder 118 is rotatably connected to the lower end of the gimbal housing 32, and an outer end of the actuator arm 116 is rotatable connected to the outer housing 22 at a point sufficiently distanced from the gimbal ring 34 to provide adequate leverage. In the illustrated embodiment, the outer ends of the actuator arms 116 attach to the outer housing 22 at a point spaced from the gimbal ring 34 by a distance generally corresponding to about two-thirds the length of the lower lever B of the linkage system. The upper ends of the actuator arms 116 attach to an upper side of the outer housing 22 at a location which does not interfere with an outer housing port to which the exhaust hose 48 attaches. Of course, other attachment points on the outer housing 22 to which the actuator arm ends can attach are also possible.

Although the actuators 114 are arranged with the actuator cylinders 118 rotatably fixed to the gimbal ring housing 32 and the ends of the actuator arms 116 are connected to the outer housing 22, the orientation of the actuators 114 can be reversed. The present position control mechanism 14 can also have only a single lift actuator located to one side of the outer housing 22, rather than the pair of lift actuators illustrated in the present embodiment.

The lift actuators 114 raise and lower the outer housing 22 of the stern drive 10. The lower lever B of the linkage system thus also raises and lowers with the motion of the outer housing 22 because the second universal joint 60 is directly connected to the outer housing 22 through the upper drive shaft 58, bevel gearset 56 and input shaft 54, the latter two of which are journaled with the outer housing 22. The rear end of the lower lever B defined by the second universal joint 60 thus moves with the lift actuators 114.

A reversible fluid pump 120 selectively pressurizes either a first conduit set 122 to pressurize the corresponding fluid motor chambers 124 within the actuator cylinders 118 to effect lift of the stern drive 10, or a second conduit set 126 to pressure corresponding fluid motor chambers 128 within the lift actuator cylinders 118 to provide lowering of the stern drive 10. A reversible electric motor 130 drives the fluid pump 120 desirably under the control of the control system 16 described below.

The drive motors 102, 130 and fluid pumps 100, 120 of the lift and trim hydraulic circuits are conventionally located within the watercraft 12 proximate to the transom 24. The fluid conduits 110, 112, 122, 126, which connect the hydraulic pumps 100, 120 to the respective actuators 84, 114, extend through sealed holes in the transom 24 and connect to the respective fluid motor chambers of the actuators.

Automatic Lift and Trim Control System

FIG. 2 illustrates the automatic control system 16 which can be used with the present adjustable stern drive 10. The automatic control system 16 desirably controls not only the desired lift and trim positions for a given watercraft running condition, but also the order in which the adjustments are effected.

The control system 16 desirably is configured in accordance with the teaching of U.S. Pat. No. 5,352,137, issued on Oct. 4, 1994, entitled "Automatic Position Controller For Marine Propulsions", and assigned to the assignee hereof. U.S. Pat. No. 5,352,137 is hereby incorporated by reference. Other control systems, such as, for example, the other embodiments disclosed in the '137 patent can be used with the present adjustable stern drive 10 as well.

In the illustrated embodiment, a lift control system 132 includes a logic controller 134 which includes a control circuit 136 for operating a power lift actuating circuit 138. The power lift actuating circuit 138 directly operates the reversible electric motor 130 of the hydraulic circuit which actuates the lift actuators 114, as described above.

The lift control system 132 also includes an operator positioned automatic or manual control selector switch 140. The switch 140 communicates with the control circuit 136 of the logic controller 134. The selector 132 operates to select either automatic control or to permit the operator to manually control the lift position of the stern drive 10.

As understood from FIG. 2, the logic controller 134 receives an input signal from a lift position sensor 142. A delay circuit 144 (e.g., a buffer) of the logic controller 134 receives this signal and passes it on to a lift comparator and control circuit 146 at a predefined time delay. The lift comparator and control circuit 146 also receives an instantaneously input signal directly from the lift position sensor 142.

The lift comparator and control circuit 146 compares the input signals from the delay circuit 144 and the lift position sensor 142 to determine whether the position control mechanism 14 is moving (i.e., lifting or lowering) the stern drive 10. If the instantaneously sensed position signal differs from the delayed position signal, the drive 10 is moving. The sign of the determined difference indicates the direction of travel, either up or down in the vertical direction.

The lift comparator and control circuit 146 also compares the input signal from the lift position sensor 142 to determine whether the stern drive 10 is at its travel limits. If so, the lift comparator and control circuit 146 generates a non-enable signal to the control circuit 136 of the logic controller 134 which prevents the control circuit 136 from energizing and/or instructs the control circuit 136 to deenergize the power lift actuating circuit 138. If the lift comparator and control circuit 142 determines that the stern drive 10 is between its travel limits, the lift circuit 146 generates and sends an enable signal to the control circuit 136 to enable the control circuit 136 to energize the power lift actuating circuit 138.

The logic controller 134 of the lift control system 132 also receives an input signal from a speed sensor 148. A speed comparator circuit 150 receives this signal and compares it against an established value maintained in a memory device, such as, for example, a memory chip, a resistive network, dip switches, or other like means. The watercraft manufacturer desirably sets the established value which corresponds to the designed planing or cruising speed of the watercraft 12.

If the speed comparator circuit 150 determines that the sensed speed is less than the preset value (i.e., less than the pre-established planing or cruising speed), the speed comparator circuit 150 sends a no lift sign to the lift comparator and control circuit 146. The lift comparator and control circuit 146 in turn does not output a lift control signal to the control circuit 136.

When the sensed speed is greater than the preset value, the speed comparator 150 generates and sends an output signal to a delay circuit 152 (e.g., a buffer) and to an acceleration or deceleration comparator circuit 154 ("A/D comparator"). The A/D comparator 154 also receives an input signal from the delay circuit 152 so as to compare the instantaneously sensed speed with the delayed speed. In this manner, the A/D comparator 154 determines whether the watercraft 12 is accelerating or decelerating.

If the A/D comparator 154 senses an acceleration condition, it sends an output signal to the lift comparator and control circuit 146 indicating that the position control device 14 should lift the stern drive 10. If the A/D comparator 154 senses a deceleration condition, however, it sends an output signal to the control circuit 136 indicating that the position control device 14 should lower the stern drive 10. And if the A/D comparator 154 senses no acceleration (i.e., no change in speed), it does not generate an output signal which is indicative of no change in position of the stern drive 10.

The control circuit 136 receives two input signals from the lift comparator and control circuit 146. The first signal enables the control circuit 136 to energize the power lift actuating circuit 138. The second signal instructs the control circuit 136 to lift the stern drive 10 when the lift comparator and control circuit 146 determines that the watercraft 12 is at or above planing speeds (as determined by the speed comparator 150) and is accelerating (as determined by the A/D comparator 154).

As noted above, the control circuit 136 also receives an input signal from the A/C comparator 154. This signal indicates that the watercraft 12 is decelerating, but is still above planing speed. Based on this information, the control circuit 136 generates an output signal to the power lift actuating circuit 138 instructing the power control mechanism 14 to lower the stern drive 10. The A/C comparator 154 thus optimizes the lift position of the stern drive 10 to achieve maximum speed at or above the designed planing speed for a given running condition of the engine.

The logic controller 134 also delays the lift operation of the stern drive 10 when the speed of the watercraft 12 is below the preestablished planing speed, but the watercraft 12 is accelerating. The present drive 10 thus gains the above noted advantage of delaying the lift operation until the watercraft 12 actually reaches its planing condition. This ensures that the propeller 20 is fully submerged during the acceleration to obtain maximum acceleration of the watercraft 12. Once the watercraft 12 reaches its planing condition, the lift operation of the stern drive lower unit 18 reduces the water resistance of the lower unit 18 and permits the propeller 20 to reach high revolutions per minute by raising at least a portion of the propeller blade out of the water.

For this purpose, if the speed competitor circuit 150 determines that the sensed watercraft speed is below the preestablished planing speed, it generates and sends an output signal to a second delay circuit 156 (e.g., a buffer or the like) and to a second acceleration or deceleration comparator circuit 158 ("the second A/C competitor"). The second A/D comparator 158 compares the instantaneously sensed watercraft speed from the speed comparator 150 with the watercraft speed at a previous time, as sent by the delay circuit 156, to determine whether the watercraft 12 is accelerating or decelerating. If the second A/D comparator circuit 158 determines that the watercraft is accelerating, it sends a no lift signal to the control circuit 136.

If the second A/D comparator circuit 158 determines that the watercraft 12 is decelerating, it sends an output signal to the control circuit 136 to lower the stern drive lower unit 18. The control circuit 136 instructs the position control mechanism 14 to lower the stern drive 10 in anticipation of the watercraft 12 slowing to a slow speed or to rest so that the drive 10 will be lowered for subsequent acceleration of the watercraft 12.

The automatic control system 16 also includes a trim control system 160. As seen in FIG. 2, the trim control system 160 includes a second logic controller 162 which receives input signals from a trim position sensor 164, a watercraft trim angle sensor 166, and a watercraft roll sensor 168. The watercraft trim angle sensor 166 indicates whether the watercraft 12 is in a planing condition by determining the angle of the hull relative to the surface of the body of water in which the watercraft 12 is operated (i.e., relative to the horizontal).

The logic controller 162 of the trim control system 160 includes a control circuit 170 for operating a power trim control circuit 172. The power trim control circuit 172 directly operates the reversible electric motor 102 of the hydraulic circuit which actuates the trim actuators 84, as described above.

The logic controller 162 controls the power trim system in the following manner. If the watercraft 12 is accelerating from rest, the logic controller 162 causes the trim angle to be adjusted through a negative range so as to provide maximum thrust for acceleration. During this phase of the operation, the propulsion shaft 66 (FIG. 6) lies at a negative trim angle θ in a trim down position to force the watercraft hull against the water. As acceleration continues, the logic controller 162 adjusts the trim angle θ of the stern drive 10 to a positive trim angle as the watercraft 12 reaches its planing speed.

The logic controller 162 includes a manual trim set control unit 174. The manual control unit 174 permits the operator to set the desired trim angle rather than using a pre-programmed desired trim angle stored within the logic controller 162.

The logic controller 162 also includes a start control switch 176 which disables the position control mechanism 14 during engine starts. This allows at least one of the electric motors 102, 130 which operates one of the hydraulic pumps 100, 120 to function also as a starter motor for the engine 42. The control switch 176 also allows the operator to manually adjust the trim position.

As seen in FIG. 2, the logic controller 162 includes a trim deviation comparator 178 which receives an input signal from the speed comparator 150 of the lift control system 132. The input signal indicates watercraft velocity, as well as whether the watercraft 12 has reached its planing speed. The trim deviation control circuit 178 generates an output signal instructing the trim control circuit 170 to send a trim up signal to the power trim control circuit 172 for effecting trim up if the watercraft 12 has reached planing speed. If this condition exists, the trim deviation control circuit 178 also outputs a signal to the lift control circuit 146 of the lift control system 132 so as to transmit a lift signal to the power lift actuating circuit 138 through the lift comparator 146 and the control circuit 136 for a brief period of time. This signal overrides the normal lift signal under the planing condition.

The trim deviation control circuit 178 also receives input signals from the trim sensor 164 and the manual trim control 174. The trim deviation control circuit 178 communicates input signals from the manual trim control 174 directly to the trim control circuit 170 for effecting the desired trim adjustment input by the watercraft operator. The trim control circuit 172 produces and generates an appropriate signal received by the power trim control circuit 170 that controls the motor 102 of hydraulic circuit powering the tilt and trim actuators 84. The desired adjustment is effected in this manner.

When operated in an automated mode and below planing speed, the trim deviation control determines 178 compares the input signal from the trim sensor 164 with a pre-established value for the sensed watercraft velocity. A memory device (not shown) communicating with the trim deviation control 178 stores the pre-established trim value for a given velocity. If the sensed trim angle differs from the desired pre-established trim angle for a given velocity, the trim deviation circuit 178 generates and communicates a control signal which the trim control circuit 170 receives. The control circuit 170 causes the power control trim circuit 172 to adjust the trim actuators 84 accordingly.

The logic controller 162 also includes a watercraft trim comparator circuit 180 that receives an input signal from the watercraft trim angle sensor 166. The comparator circuit 180 compares the sensed angle with an established angle maintained in a memory device. The watercraft manufacturer desirably sets the established value which indicates the desired angle of the planing condition. In this manner, the comparator circuit 180 determines whether the watercraft 12 is on plane. If so, the comparator circuit 180 generates and sends a trim up signal to the trim control circuit 170 that effects trimming up through the power trim control 172.

The logic controller 162 also includes a differentiating circuit 182 that differentiates the sensed watercraft trim angle. The differentiating circuit 182 sends an output signal to a rate of change circuit 184 that determines whether the power trim control 172 should trim up or trim down the watercraft 12. If so, the rate of change circuit 184 generates and sends an appropriate signal to the trim control 172 for effecting trim adjustment of the stern drive 10.

The watercraft roll sensor 168 produces an input signal received by a differentiator 186. The differentiator 186 differentiates the sensed roll position of the watercraft 12. The differentiator 186 sends an output signal to a comparator circuit 188 that determines whether a watercraft roll condition exists. If so, the comparator circuit 188 generates and sends a trim down signal to the trim control 172 to effect trim down to stabilize the watercraft 12.

The logic circuit 162 of the trim control system 160 also receives a trim down signal from the second acceleration or deceleration comparator circuit 158 of the lift control system 132 in the event that the output of the circuit 158 indicates that lift down and trim down are required for the given watercraft running condition.

Operation of Position Control System

The following elaborates on the previous description of the operation of the position control mechanism 14 and the automatic control system 16 principally in view of FIGS. 5 through 9. To accelerate from rest or from a slow speed, the automatic control system 16 instructs the position control mechanism 14 to position the stern drive lower unit 18 in a fully lowered position. In this position, as seen in FIG. 5, the lift actuators 114 are in a retracted position. The hydraulic pump 120 has pressurized the upper fluid motor chambers 124 of the actuator cylinders 118 to move the lift actuators 114 into this position. So positioned, the input shaft 54 and the outer housing 22 of the propulsion drive train 40 extends at about a −15° to −20° angle α relative to the output shaft 44 from the engine 42.

The control system 16 also instructs the position control mechanism 14 to adjust the trim position of the lower unit 18. The control system 16 specifically send a signal to the power trim control circuit 172 which causes it to energize the hydraulic motor 102 and pump 100 of the power trim system. The hydraulic pump pressurizes an inner fluid motor chamber 108 (i.e., the fluid motor chamber closest to the watercraft transom 24) within the tilt and trim actuator cylinders 88 to extend the actuator arm 86 to a position corresponding to the full trim down (i.e., full trim in) position of the lower unit 18 and propulsion shaft 66.

As understood from FIG. 6, the extending tilt and trim actuator arms 86 move the joint P rearward to increase the length of the upper lever C of the linkage system. The lower lever B of the linkage system remains stationary as the outer housing 22 does not move during trim adjustment. As a result of the length of the upper lever C increasing and the length of the lower lever B remaining constant, the lower unit 18 pivots about the hinge coupling between the lower unit 18 and the outer housing 22. The angle τ between the lower drive shaft 62 and the connecting link line D of the linkage system, however, remains constant as the lower unit 18 moves to its full trim down position.

The shaft angle β (see FIG. 4) between the upper and lower drives shafts 58, 62 increases in the trim down position. The flexible coupling provided by the second universal joint 60 permits the relative movement between the shafts 58, 62 which are joined at a point lying along the pivot axis of the lower unit 18.

It should also be noted that by connecting the tilt and trim actuators 84 to the bracket 94 attached to the lower unit 18 at a point rearward of and distanced from the fulcrum of the lower unit 18, the tilt and trim actuators 84 can rotate the lower unit 18 with a reasonable amount of hydraulic force. Conventional marine hydraulic circuit components thus can be used with the present stern drive 10.

As understood from FIG. 6, the propulsion shaft lies at about a −15° to −20° trim angle θ relative to the horizontal when the lower unit 18 lies in the full trim down position. The propeller 20 desirably lies beneath the keel line of the watercraft 12 with the stern drive 10 fully lowered and the lower unit 18 fully trimmed down. This initial position of the stern drive 10 forces the bow of the watercraft 12 against the water to assist the watercraft 12 up on plane, as known in the art.

As acceleration continues and the speed of the watercraft 12 increases, the control system 16 instructs the position control mechanism 14 to adjust the trim position of the lower unit 18. The control circuit 170 send a signal to the power trim control circuit 172 which causes it to energize the hydraulic motor 102 and pump 100 of the power trim system. The hydraulic pump 100 pressurizes an outer fluid motor chamber 108 within the tilt and trim actuator cylinders 84 to retract the actuator arm 86.

The retracting tilt and trim actuator arms 86 move the joint P forward to decrease the length of the upper lever C of the linkage system. This causes the lower unit 18 to pivot about its hinge coupling with the outer housing 22 to decrease the trim down angle. Again, the angle τ between the lower drive shaft 62 and the connecting link line D of the linkage system remains constant as the lower unit 18 moves towards a zero trim angle θ. The shaft angle β between the upper and lower drives shafts 58, 62, however, decreases with this movement of the lower unit 18.

The adjustment of the trim angle θ continues in this manner as the watercraft 12 approaches planing speed. To assist the watercraft 12 up on plane, the control system 16 adjusts the trim angle of the stern drive 10 to a positive trim angle θ (i.e., to a trim up position), as seen in FIG. 7. This forces the bow of the watercraft 12 out of the water such that only a portion of the hull contacts the water.

The control system 16 instructs the position control mechanism 14 to trim up the lower unit 18 as the watercraft 12 nears planing speed. The control system 16 send a signal to the power trim control circuit 172 which causes it to energize the hydraulic motor 102 and pump 100 of the power trim system. The hydraulic pump 100 pressurizes an outer fluid motor chamber 108 within the tilt and trim actuator cylinders 84 to further retract the actuator arm 86.

As understood from FIG. 7, the retracting the tilt and trim actuator arms 86 decrease the length of the upper lever C of the linkage system, as described above, which causes the lower unit 18 to pivot about the hinge coupling with the outer housing 22. This rotational movement of the lower unit 18 positions the lower unit 18 and propulsion shaft 66 at a positive trim angle θ relative to the horizontal. At and above planing speed, the trim angle θ desirably is within the range from about 4° to 10°.

The angle τ between the lower drive shaft 62 and the connecting link line D of the linkage system remains constant as the lower unit 18 moves to a positive trim angle (i.e., a trim up position). The shaft angle β between the upper and lower drives shafts 58, 62 continues to decrease with this movement of the lower unit 18.

Figure 8:
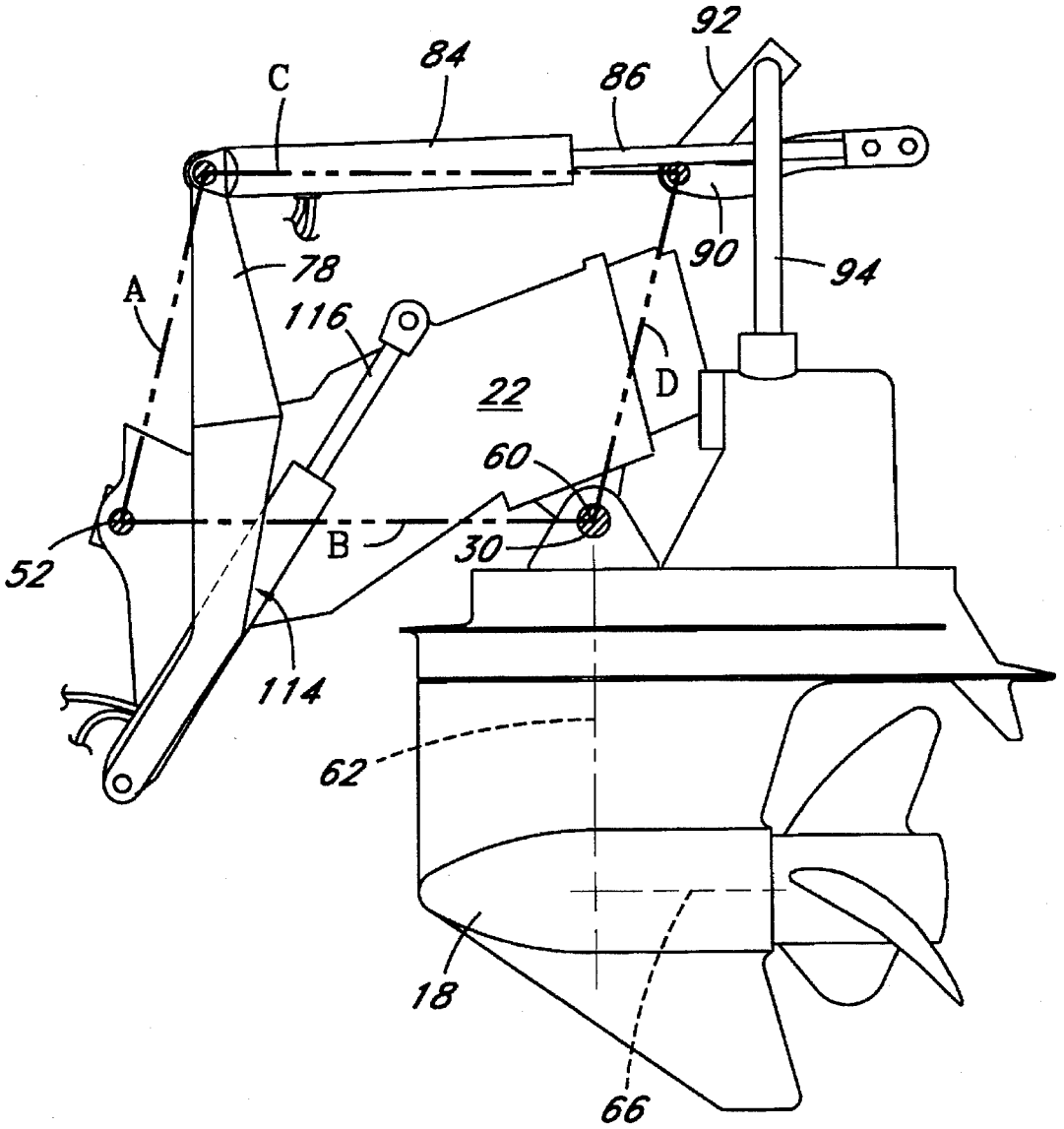
FIG. 8 is a schematic side elevational view of the position control mechanism of FIG. 5 with the marine stern drive in a raised position at a zero trim angle.

With reference to FIG. 8, once the watercraft 12 has reached planing speed, the lift control system 16 activates to raise the stern drive 10 relative to the water surface. This subsequent lifting of the stern drive 10 ensures minimum flow resistance (i.e., drag) on the lower unit 18 and changes the line of thrust to reduce the moment on the watercraft 12 as a result of thrust and drag forces. It also moves the propeller further behind the transom 24 into deeper water (i.e., beyond the recovery zone of the water directly behind the transom 24). If a surface piercing propeller is used, the lift operation also raises the propeller slightly out of the water to foster maximum revolutions per minute of the propeller and to provide some additional lift.

Figure 9:
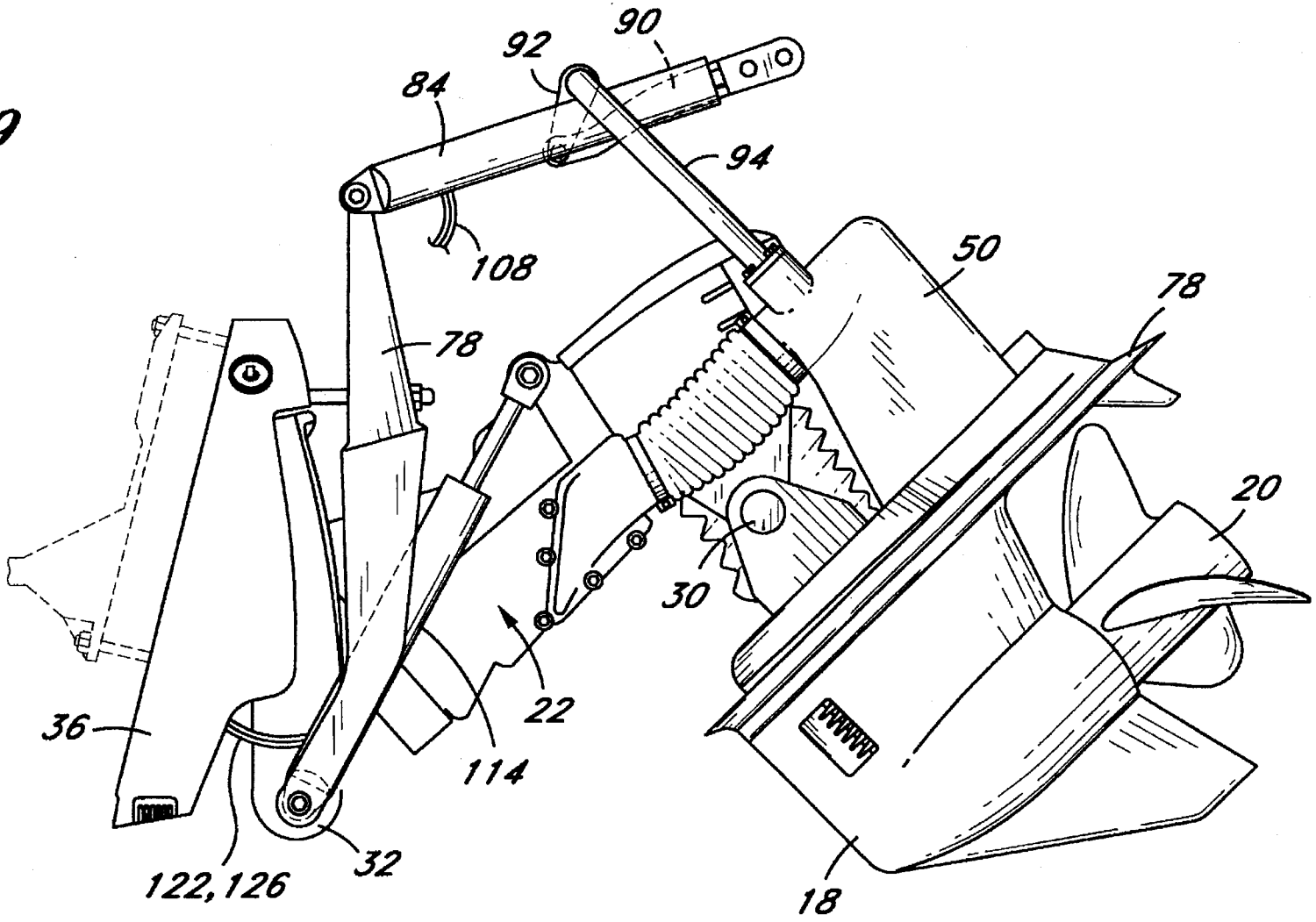
FIG. 9 is a side elevational view of the marine stern drive of FIG. 3 in a raised, full tilt-up position.

It should be understood, that the position control mechanism 14 can position the lower unit 18 at any point between a fully lowered position (as seen in FIG. 5) and a fully raised position (as seen in FIG. 8) during a normal running condition, and can raise the lower unit further from the fully raised position to a storage position, seen in FIG. 9 and described below. The control system 16, when operated either manually or automatically, also can instruct the position control mechanism to stop at any position within the lift range of the position control device 14.

To lift the lower unit 18, the lift control system 16 via the lift comparator and control circuit 146 instructs the control circuit 136. If the other conditions discussed above are satisfied, the control circuit 164 generates and sends a lift signal to the power lift actuating circuit 138 which in turn energizes the hydraulic motor 130 and pump 120 of the hydraulic lift circuit. The hydraulic pump 120 energizes a lower fluid motor chamber 128 within the lift actuator cylinders 118. This extends the actuator arms 116.

The extending actuator arms 116 rotate the outer housing 22, input shaft 54, and upper drive shaft 58 about a lateral axis passing through the first universal joint 52 and gimbal ring 34. The gimbal ring 34 and the first universal joint 52 permit this movement relative to the transom bracket 36 and the output shaft 44. The lower lever B of the linkage system rotates with the movement of the outer housing 22, input shaft 54 and upper drive shaft 58 as this linkage lever B is defined between the forward end of the input shaft 54 and the lower end of the upper drive shaft 58.

The rotational movement of the lower lever B causes its outer end, which is defined by the second universal joint 60 (as well as by the hinge point of the lower unit 18), to rise. The lower unit 18 follows this upward movement due to the direct connection between the lower unit 18 and the hinge connection at the outer end of the lower lever B. In this manner, the lift actuators 114 lift the stern drive 10.

The rotational movement of the lower lever B also moves the propeller 20 of the lower unit 18 further away from the watercraft transom 24 in the longitudinal direction. This occurs as the outer housing 22 and input shaft 54 swing from a −15° to −20° shaft angle α relative to the output shaft 44 to a 0° shaft angle α. At a 0° shaft angle α, the propeller 20 lies at its furthest distance from the transom 24 of the watercraft 12.

Importantly, the trim angle θ of the propulsion shaft 66 does not change as the position control mechanism 14 lifts the stern drive 10. This is a result of the parallelogram structure of the linkage system which permits the angles between the linkage members to change with rotation of the lower lever B.

As understood from FIG. 7, the upward movement of the lower linkage B also moves the upper lever C which are directly connected to the bracket 94. The length of the upper lever C and link line D remain constant, but the angles between these links change. The swing arm 90 also rotates about the pivot point P with the rotation of the upper lever C. The angle $\tau$ between the lower drive shaft 62 and the link line D also changes during the lift operation. In this manner, the trim angle $\theta$ of the propulsion shaft 66 remains constant as the position control mechanism 14 raises the lower unit 18.

As noted above, the control system 16 adjusts the lift position of the stern drive 10 once on plane to maximize watercraft velocity. If the control circuit 136 of the logic controller 132 receives a lift down signal from the first A/D comparator 154, the control circuit 136 generates and sends a lift down signal to the power lift actuating circuit 138, which slightly lowers the stern drive 10 in the manner described above.

As noted above, the abnormally long outer housing 22 of the present position control mechanism 14 distances the propeller 20 further away from the watercraft transom 24 than prior designs. This allows the propeller 20 to operate in the deeper water beyond the water recovery zone created directly behind the watercraft transom 24. As a result, the propeller 20 can run more shallow and possible with less cavitation. In addition, the lower unit 18 can employ a propeller with larger propeller blades which is known to contribute to improved fuel economy. The extended length of the stern drive 10 also shifts the center of gravity of the watercraft 12 further aft which improves the lift on the watercraft 12 as known in the art.

The position control mechanism 14 also can be used at slow speeds. The operator can manually adjust the lift position of the stern drive 10 for a shallow running condition if operating the watercraft 12 in shallow water.

The position control mechanism 14 further allows the stern drive 10 to be fully tilt up for storage, especially when operated in salt water. As seen in FIG. 9, the position control mechanism 14 can lift the stern drive 10 to a position where the input shaft 54 and outer housing 22 lie at about a 25° shaft angle relative to the output shaft 44. The tilt and trim cylinders 84 also can be fully retracted to fully tilt up the lower unit 18. The position control mechanism 14 raises the lower unit 18 completely out of the water with the stern drive 10 in this full tilt position. This storage position inhibits corrosion damage to the propeller 20 and lower unit 18, as well as improves dock maneuverability of the watercraft 12.

Although this invention has been described in terms of a certain preferred embodiment, other embodiments apparent to those of ordinary skill in the art are also within the scope of this invention. For instance, the present position control mechanism can be adapted for used with a propulsion drive train which extends over the watercraft transom rather than though it. Accordingly, the scope of the invention is intended to be defined only by the claims which follow.

What is claimed is:

1. An adjustable stern drive for a watercraft comprising a propulsion device arranged to lie at least partially below a surface of a body of water in which the watercraft is operated, said propulsion device adapted to produce a thrust along a thrust vector which defines a thrust angle relative to the water surface, and a position control mechanism attached to said propulsion device, said position control mechanism adapted to move said propulsion device between a lowered position, in which said propulsion device lies at a first distance from the water surface, to a raised position, in which said propulsion device lies at a second distance from the water surface, without substantially changing the thrust angle between said thrust vector and the water surface.

2. An adjustable stern drive as in claim 1, where said first distance is greater than said second distance.

3. An adjustable stern drive as in claim 2, wherein said second distance substantially equals zero.

4. An adjustable stern drive as in claim 1, wherein said position control mechanism comprises a linkage system formed at least in part by at least first and second members, each member having front and rear ends, a first lever line being defined between the front and rear ends of the first member and a second lever line being defined between the front and rear ends of the second member, the first and second lever lines being generally parallel to each other, corresponding front ends of the members each being rotatable fixed with the corresponding rear ends being interconnected such that rotational movement of the first member about its fixed front end rotates the second member about its fixed front end by the same degree.

5. An adjustable stem drive as in claim 4, wherein said first member is adjustable in length such that said rear end of said first member moves between an extended position and a retracted position, the rear ends of the first and second members defining a link line, said link line and said second lever line defining a first angle with the rear end of the first member in an extended position, and defining a second angle with the rear end of the first member in a retracted position, said first and second angles being unequal.

6. An adjustable stem drive as in claim 5, wherein said position control mechanism is adapted to change the thrust angle of said propulsion device with movement of said rear end of said first member between said extended and retracted positions.

7. An adjustable stern drive as in claim 5, wherein the rear end of said second member corresponds with a hinge point of a lower unit of the stem drive, said rear ends of said first and second members being interconnected at least in part by a bracket attached to said lower unit.

8. An adjustable stern drive as in claim 7, wherein a flexible coupling interconnects the rear end of said first member with said bracket.

9. An adjustable stern drive as in claim 8, wherein said flexible coupling is formed by a swing arm pivotable coupled to said bracket.

10. An adjustable stem drive as in claim 9, wherein said first member comprises an actuator having an extendable arm.

11. An adjustable stern drive as in claim 10, wherein the rear pivot point of said first lever line is defined at a point on an arm connected to said actuator.

12. An adjustable stern drive as in claim 5, wherein said second member is formed in part by a portion of a propulsion drive train of said stern drive.

13. An adjustable stern drive as in claim 12, wherein said front pivot point of said second member is defined in part by a first flexible shaft coupling and said rear pivot point of said second member is defined by a second flexible shaft coupling.

14. An adjustable stern drive as in claim 13, wherein an input shaft and an upper drive shaft of said propulsion drive train interconnect said first and second flexible shaft couplings.

15. An adjustable stern drive as in claim 14, wherein a drive transfer mechanism interconnects said input shaft and said upper drive shaft.

16. An adjustable stern drive as in claim 14, wherein said first flexible coupling connects said input shaft to a rotationally driven output shaft, said input shaft lying at a negative shaft angle relative to said output shaft with said stern drive in said lowered position.

17. An adjustable stern drive as in claim 16, wherein said input shaft lies at a positive shaft angle relative to said output shaft with said stern drive in said raised position.

18. An adjustable stern drive as in claim 17, wherein at least one lift actuator is coupled to said input shaft in a manner pivoting said input shaft about said first flexible coupling when said lift actuator is actuated.

19. An adjustable stern drive as in claim 13 additionally comprising a lower drive shaft which depends from said second flexible coupling, said link line and said lower drive shaft forming an angle which remains constant as said rear end of said first lever moves between said extended and retracted positions.

20. An adjustable stern drive as in claim 19, wherein said angle between said lower drive shaft and said link line remains substantially constant as said stern drive moves between said lowered and raised positions.

21. An adjustable stern drive as in claim 1, wherein said position control mechanism is adapted to raise said stern drive from said raised position to a tilt-up position where said propulsion drive is positioned further from the water surface.

22. A stern drive for a watercraft comprising an output shaft adapted to be rotationally driven by a motor and connected to an input shaft of a propulsion drive train by a first flexible coupling, a first drive transfer mechanism connecting said input shaft to an upper drive shaft of said drive train, said upper drive shaft being skewed or normal to said input shaft, a second flexible coupling connecting said upper drive shaft to a lower drive shaft of said propulsion drive train, and a second drive transfer mechanism which selectively couples said lower drive shaft to at least one propulsion shaft which drives at least one propulsion device of said stern drive.

23. A stern drive for a watercraft as in claim 22, additionally comprising a position control mechanism which is adapted to move said stern drive between a lowered position and a raised position.

24. A stern drive as in claim 23, wherein said input shaft lies at a negative shaft angle relative to said output shaft with said stern drive in said lowered position.

25. A stern drive as in claim 24, wherein said input shaft lies at a positive shaft angle relative to said output shaft with said stern drive in said raised position.

26. A stern drive as in claim 25, wherein said position control mechanism comprises at least one lift actuator which is coupled to said input shaft in a manner pivoting said input shaft about said first flexible coupling when said lift actuator is actuated.

27. A stern drive as in claim 23, wherein said upper and lower drive shafts intersect at a shaft angle which remains constant as said position control mechanism raises and lowers said stern drive.

28. A stern drive as in claim 27, wherein said position control mechanism includes a variable-length actuator which rotates a lower unit of said stern drive about a lateral axis when actuated so as to change a trim angle formed between the propulsion shaft and the horizontal.

29. A stern drive as in claim 28, wherein said second flexible coupling is positioned such that the lateral rotational axis passes through said second flexible coupling to permit said shaft angle between upper and lower drive shafts to change as said position control mechanism changes the trim angle of said propulsion shaft.

30. A stern drive as in claim 22, wherein said first drive transfer mechanism comprises a bevel gearset.

31. A stern drive as in claim 22, wherein said second drive transfer mechanism is a transmission which establishes at least three driving conditions for said propulsion shaft.

32. A stern drive as in claim 22, wherein said transmission is adapted to establish at least three driving conditions for said propulsion shaft.

33. A stern drive as in claim 22, wherein said propulsion device comprises a propeller.

34. A position control mechanism for supporting a marine outboard drive comprising a linkage system formed by at least first and second members, each member extending between a front pivot point and a rear pivot point, a first lever line being defined between the front and rear pivot points of the first member and a second lever line being defined between the front and rear pivot points of the seconal member, the pivot points of the first and second members being arranged such that first and second lever lines are parallel to each other, a link line being defined between the rear pivot points of the first and second members, said first member being adjustable in length so as to change an angle between said link line and the second lever line.

35. A position control mechanism as in claim 34, wherein a shaft of a propulsion drive train of said outboard drive depends from a flexible shaft coupling positioned at the rear pivot point of said second lever line, said shaft forming an angle with said link line which remains substantially constant with a change in length of said first member.

36. A position control mechanism as in claim 34, wherein said position control mechanism is adapted to change a trim angle of said outboard drive with movement of said first member.

37. A position control mechanism as in claim 34, wherein said first member comprises an actuator having an extendable arm.

38. A position control mechanism as in claim 34, wherein said first and second members each include a front end which is rotatable fixed at the corresponding front pivot point, the rear ends of said first and second members being interconnected such that a degree of rotational movement of said second member about its fixed front end rotates said first member about its fixed front end by the same degree.

39. A position control mechanism as in claim 38, wherein a lower unit of said outboard drive is coupled to a rear end of said second member such that rotational movement of said second member raises and lowers said lower unit relative to a water surface of the body of water in which the outboard drive is operated.

* * * * *

UNITED STATES PATENT AND TRADEMARK OFFICE

CERTIFICATE OF CORRECTION

PATENT NO. : 5,647,780

DATED : July 15, 1997

INVENTOR(S) : Yukiharu Hosoi

It is certified that error appears in the above-identified patent and that said Letters Patent is hereby corrected as shown below:

In Claim 5, Column 16, Line 20, "stem drive" should be --stern drive--.

In Claim 6, Column 16, Line 29, "stem drive" should be --stern drive--.

In Claim 7, Column 16, Line 36, "stem drive" should be --stern drive--.

In Claim 10, Column 16, Line 45, "stem drive" should be --stern drive--.

Claim "31" should be renumbered to --32--.

Claim 32 should be stricken.

Please insert Claim 31 as follows:

--A stern drive as in Claim 30, wherein said input shaft and said upper drive shaft intersect at about a 90° shaft angle.--

In Claim 34, Column 18, Line 25, "seconal" should be --second--.

Signed and Sealed this

Thirteenth Day of October 1998

*Attest:*

*Attesting Officer*

Bruce Lehman

BRUCE LEHMAN

*Commissioner of Patents and Trademarks*